United States Patent [19]

Kato et al.

[11] Patent Number: 4,886,082

[45] Date of Patent: Dec. 12, 1989

[54] CLEANING APPARATUS

[75] Inventors: Satoshi Kato, Aichi; Hisahito Kanasashi, Gifu, both of Japan

[73] Assignee: Brother Kogyo Kabushiki Kaisha, Aichi, Japan

[21] Appl. No.: 68,532

[22] Filed: Jul. 1, 1987

[30] Foreign Application Priority Data

| | | | |
|---|---|---|---|
| Jul. 2, 1986 | [JP] | Japan | 62-155795 |
| Dec. 26, 1986 | [JP] | Japan | 62-199626 |
| Dec. 26, 1986 | [JP] | Japan | 62-199627 |

[51] Int. Cl.[4] ..... B08B 3/12

[52] U.S. Cl. ..... 134/60; 134/76; 134/107; 134/109; 134/184; 134/61

[58] Field of Search ..... 134/60, 61, 76, 105, 134/107, 109, 137, 184

[56] References Cited

U.S. PATENT DOCUMENTS

| | | | |
|---|---|---|---|
| 2,366,949 | 1/1945 | Woppman et al. | 134/105 X |
| 2,949,119 | 8/1960 | Smith | 134/107 X |
| 3,292,576 | 12/1966 | Lindemann | 134/105 X |
| 3,718,147 | 2/1973 | Laroche | 134/109 X |
| 3,951,682 | 4/1976 | Schevey et al. | 134/109 X |
| 4,224,110 | 9/1980 | McCord | 134/105 X |
| 4,240,453 | 12/1980 | Vial et al. | 134/10 X |
| 4,337,121 | 6/1982 | English | 134/109 X |

FOREIGN PATENT DOCUMENTS 46-10462 4/1971 Japan .

*Primary Examiner*—Frankie L. Stinson
*Attorney, Agent, or Firm*—Finnegan, Henderson Farabow, Garrett and Dunner

[57] ABSTRACT

A cleaning apparatus which includes an ultrasonic cleaning tank, a rinse cleaning tank, a vapor cleaning tank and a distilling tank. The distilling tank has, at its inner lower portion, a heater. Means are provided for directing the flow of the cleaning liquid in each of the ultrasonic, vapor and rinse cleaning tanks into the distilling tank. Cooling means are disposed above the level of the cleaning liquid in each of the tanks to condense rinsing cleaning liquid vapors. Supply means supply a cleaning liquid cooled by the cooling means into the rinse cleaning tank and the vapor cleaning tank.

11 Claims, 4 Drawing Sheets

CLEANING APPARATUS

BACKGROUND OF THE INVENTION

1. Field of the Invention

The present invention relates to a cleaning apparatus for cleaning an object by utilizing an ultrasonic wave.

2. Description of the Prior Art

Conventionally, an ultrasonic cleaning apparatus, as shown in FIG. 1, is provided with an ultrasonic cleaning tank 2 having an ultrasonic vibrator 3, a vapor cleaning tank 4 having a heater 5 at its inner lower portion, and a rinse cleaning tank 6 disposed between the ultrasonic cleaning tank 2 and the vapor cleaning tank 4. The conventional ultrasonic cleaning apparatus is arranged such that the cleaning liquid in the rinse cleaning tank 6 is made to flow over into the ultrasonic cleaning tank 2 and the cleaning liquid in the ultrasonic cleaning tank 2 is made to flow over into the vapor cleaning tank 4. The polluted cleaning liquid in the vapor cleaning tank 4 is led into a distilling device 9, provided separately from the cleaning device 1, to be distilled therein. The distilled cleaning liquid is made to flow back into the cleaning device 1 to replenish the cleaning liquid supply with clean cleaning liquid. An object to be cleaned is moved from the ultrasonic cleaning tank 2 to the vapor cleaning tank 4 through the rinse cleaning tank 6.

In the conventional ultrasonic cleaning apparatus, however, there is a problem in that the polluted cleaning liquid in the ultrasonic cleaning tank 2, in which the first cleaning step of an object is flow over into the vapor cleaning tank 4 in which further cleaning of the object is performed, and then the polluted cleaning liquid is heated in the vapor cleaning tank 4. Thus, not only the cleaning liquid in the ultrasonic cleaning tank 2 but the impurities in the cleaning liquid in the vapor cleaning tank 4 are vaporized together. The impurities attach onto the object to be cleaned which lowers the cleaning ability of the apparatus and make it necessary to replace the cleaning liquid after a very short time.

SUMMARY OF THE INVENTION

It is therefore an object of the present invention to solve or mitigate these and other problems in the prior art.

It is another object to provide an ultrasonic cleaning apparatus in which a cleaning liquid in each cleaning tank is always kept clean and in which an object to be cleaned can be thoroughly cleaned.

In order to attain the above-mentioned objects, and in accordance with the purposes of the invention as embodied and broadly described herein, an ultrasonic cleaning apparatus is provided which includes an ultrasonic cleaning tank, a vapor cleaning tank, a rinse cleaning tank and a distilling tank having at its inner lower portion a heater. Means are provided for directing the flow of a cleaning liquid in each of the ultrasonic cleaning tank, the vapor cleaning tank and the rinse cleaning tank into the distilling tank. Supply means are provided for supplying a cleaning liquid into the rinse cleaning tank and the vapor cleaning tank which has been condensed by a cooling means.

In accordance with the present invention, the apparatus is arranged as described above, so that the polluted cleaning liquid in each of the ultrasonic and vapor cleaning tanks is made to overflow into the distilling tank, and the vapor obtained through heating and vaporization in the distilling tank is cooled to its condensation point by the cooling means. The liquid obtained in the cooling means is supplied to the rinse cleaning tank and the vapor cleaning tank by the supply means. Thus, the cleaning liquid in each cleaning tank is always clean.

BRIEF DESCRIPTION OF THE DRAWINGS

The accompanying drawings, which are incorporated and constitute a part of the specification, illustrate a preferred embodiment of the invention and, together with the general description of the preferred embodiment given below, serve to explain the principles of the invention.

DESCRIPTION OF THE PREFERRED EMBODIMENT

Reference will now be made in detail to the present preferred embodiment of the invention as illustrated in the accompanying drawing.

Figure 2:
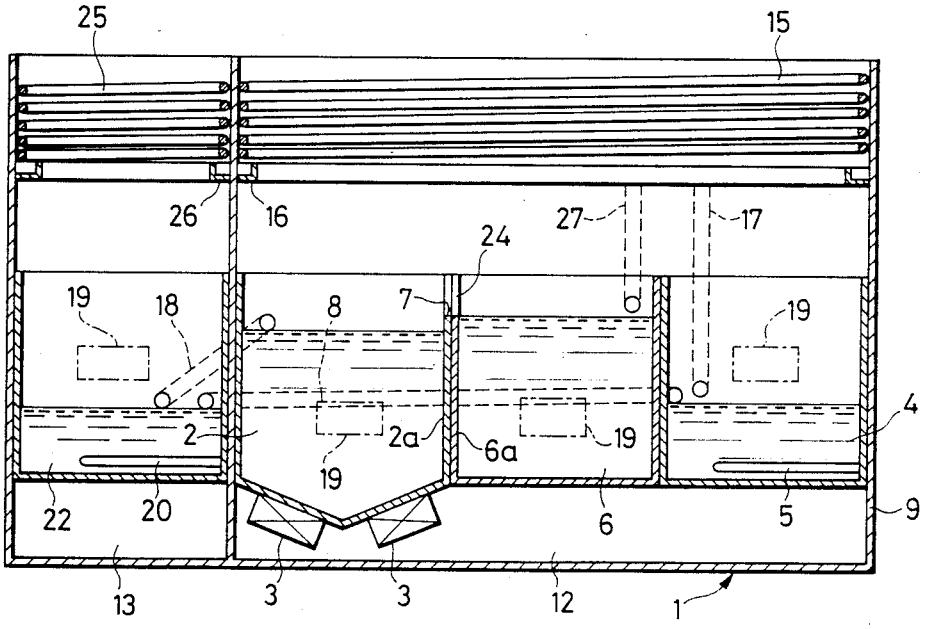
FIG. 2 is a cross-sectional view of an ultrasonic cleaning apparatus in accordance with the present invention.

Referring now to FIG. 2, an embodiment of the ultrasonic cleaning apparatus in accordance with the present invention will be described.

An ultrasonic cleaning apparatus 1 is provided with a frame 9 having two chambers 12 and 13 which are open on the top sides thereof. In the chamber 12, there are provided an ultrasonic cleaning tank 2 having an ultrasonic vibrator 3 attached to its bottom surface, a vapor cleaning tank 4, having a heater 5 disposed at its inside lower portion, and a rinse cleaning tank 6 disposed between the ultrasonic cleaning tank 2 and the vapor cleaning tank 4. In the chamber 13, there is provided a distilling tank 22 having a heater 20 disposed at its inside lower portion. Each of the tanks 2, 4, 6, and 22 are filled with, for example, a flon cleaning liquid.

At an upper portion of the chamber 12, cooling tubes 15 are attached and extend along the inner periphery of the chamber 12 so that the flon vapor obtained through vaporization in the ultrasonic cleaning tank 2 and the rinse cleaning tank 6, and the flon vapor obtained through heating and vaporization in the vapor cleaning tank 4 are cooled to at least the condensation point of the flon vapor to prevent the flon vapor from flowing upwards out of the apparatus 1. Similarly, cooling tubes 25 are attached at an upper portion of the chamber 13 and extend along its inner periphery so that the flon vapor obtained through heating and vaporization in the distilling tank 22 is cooled to at least the condensation point of flon vapor to prevent the flon vapor from flowing upwards out of the apparatus 1. Sluiceways 16 and 26, interconnected with each other, are attached under the cooling tubes 15 and 25, respectively. Tubes 17 and 27 extending to the vapor cleaning tank 4 and the rinse cleaning tank 6, respectively, are connected to the sluiceway 16.

Opposing notches 7 and 24 are formed at the upper portions of the side walls **2*a* and 6*a*, respectively, of the ultrasonic cleaning tank 2 and the rinse cleaning tank 6**, respectively, so that the cleaning liquid in the rinse cleaning tank 6 flows over the notched portions 7 and 24 into the ultrasonic cleaning tank 2. Tubes 8 and 18 are connected between the vapor cleaning tank 4 and the distilling tank 22 and between the ultrasonic cleaning tank 2 and the distilling tank 22, respectively. The tubes 8 and 18 are attached to the rear surface of the frame 9 such that tubes 8 and 18 are slanted gradually downwards toward the distilling tank 22.

The operation of the embodiment of the invention hereinabove described will now be described.

After being cleaned by vapor in the distilling tank 22, an object to be cleaned 19 is moved successively through the ultrasonic cleaning tank 2, the rinse cleaning tank 6, and the vapor cleaning tank 4 for further cleaning. The cleaning liquids which have been polluted, as a consequence of cleaning the object 19 in the ultrasonic cleaning tank 2 and the vapor cleaning tank 4, are directed into the distilling tank 22 through the tubes 18 and 8. The cleaning liquid collected in the distilling tank 22 is heated and vaporized by the heater 20 and the vapor is employed to clean another object 19.

The vapor which has not attached onto the object 19 in vapor cleaning in the distillation tank 22 rises to be cooled by the cooling tubes 25 so as to be liquefied and drip from the cooling tubes 25 into the sluiceway 26. Similarly, the vapor which has not attached onto the object 19 in vapor cleaning in the vapor cleaning tank 4 rises to be cooled by the cooling tubes 15, is condensed and drips into sluiceway 16. The cleaning liquid dripping in the sluiceways 16 and 26 is supplied to the vapor cleaning tank 4 and the rinse cleaning tank 6 through the tubes 17 and 27, respectively.

Accordingly, all the polluted cleaning liquids are led into the distilling tank 23 to be distilled so as to obtain a purified cleaning liquid. The pure cleaning liquid from the distilling tank 23 is then resupplied to the tanks 2, 4, and 6. Thus, the cleaning liquids in the tanks 2, 4 and 6 are always circulated and purified. Further, the steps of cleaning the object 19 are arranged so that after being cleaned by vapor in the distilling tank 22, the object 19 is subjected to cleaning successively in the tanks 2, 6, and 4. Accordingly, the object 19 can be cleaned to a certain degree before it is subjected to cleaning in the ultrasonic cleaning tank 2, so that the object 19 can be thoroughly cleaned. Further, the distilling tank 22 can be constructed as an integral part of the cleaning apparatus 1, so that the whole of the apparatus can be made as compact as practicable.

Figure 1:
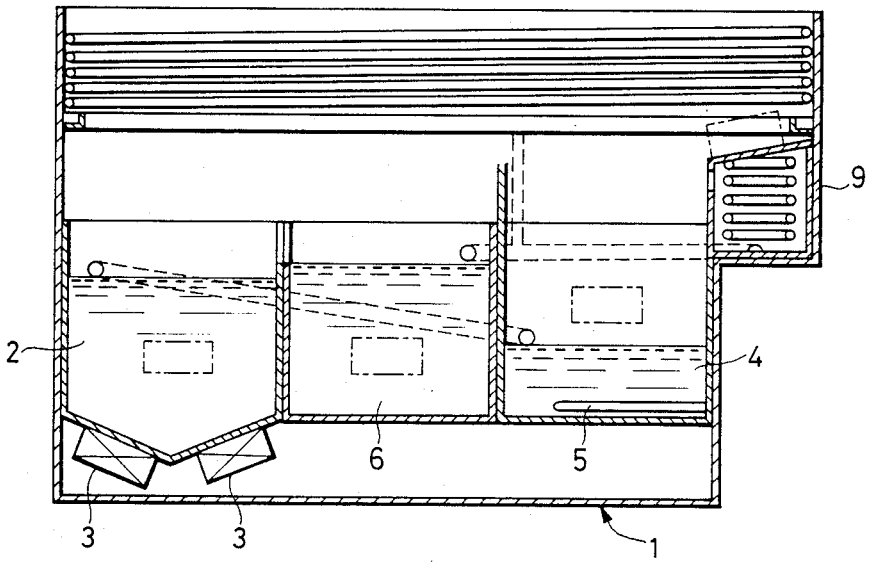
FIG. 1 is a cross-sectional view of an ultrasonic cleaning apparatus of the prior art.
Figure 3:
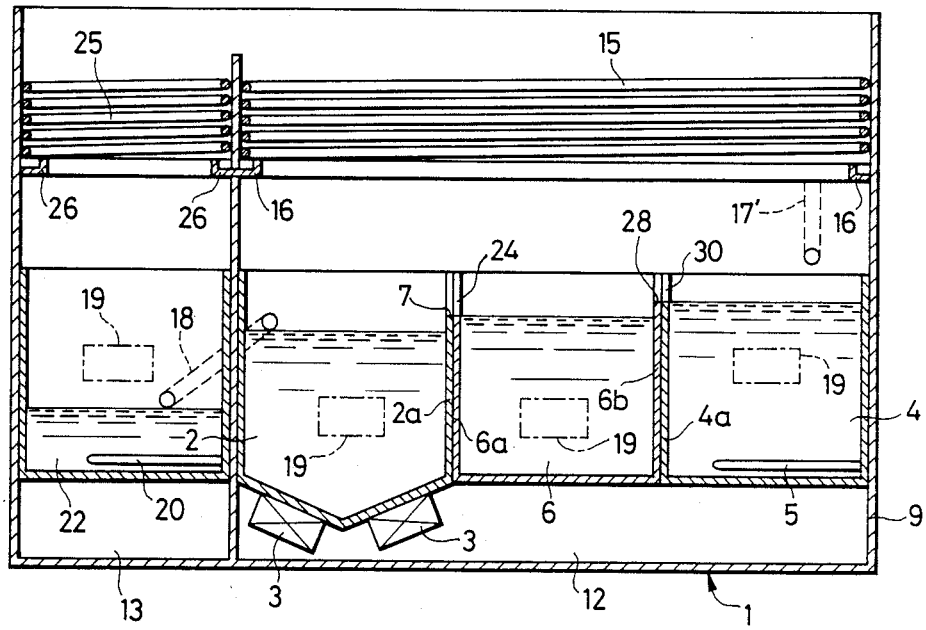
FIG. 3 is a cross-sectional view of an ultrasonic cleaning apparatus in accordance with the present invention.
Figure 4:
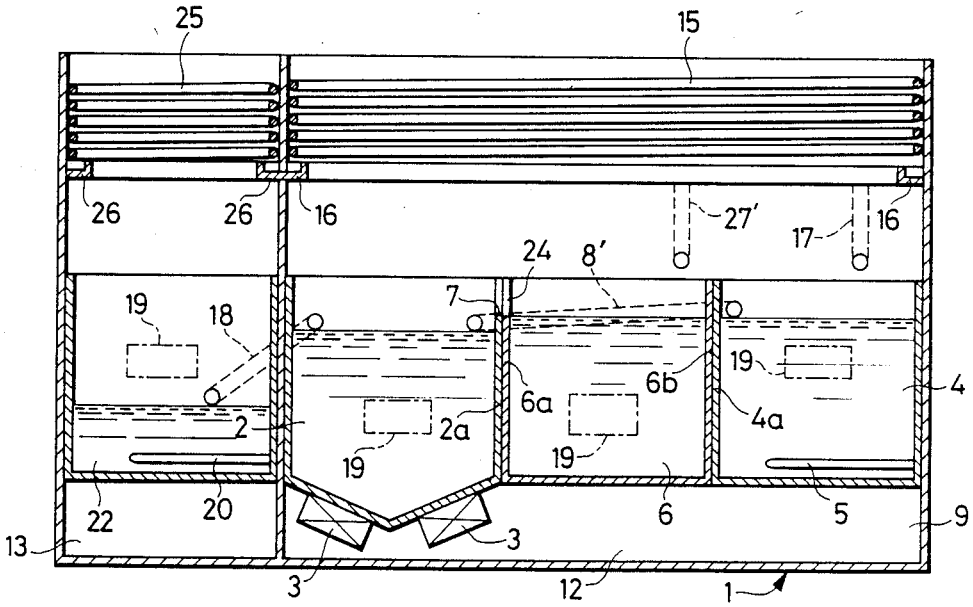
FIG. 4 is a cross-sectional view of an ultrasonic cleaning apparatus in accordance with the present invention.

A second and third embodiment of the present invention will be described hereunder having reference to FIGS. 3 and 4, respectively. In FIGS. 3 and 4, items the same as or equivalent to those shown in FIG. 1 and described in reference thereto, are correspondingly referenced unless indicated otherwise.

In the second embodiment of the present invention illustrated in FIG. 3, sluiceways 16 and 26, connected with each other, are attached under cooling tubes 15 and 25, respectively, and a tube 17′ extending to a finish cleaning tank 4 is connected to the sluiceway 16. Opposing notched portions 28 and 30 are formed at the upper portions of the side walls 6*b* and 4*a*, respectively, in the rinse cleaning tank 6 and finish cleaning tank 4, respectively. Thus, the cleaning liquid in the finish cleaning tank 4 may flow over the notched portions 28 and 30 into the rinse cleaning tank 6.

After cleaning by vapor in a distilling tank 22, an object to be cleaned 19 is moved successively through a dip cleaning tank 2, the rinse cleaning tank 6, and the finish cleaning tank 4 so as to be subjected to a sequence of cleaning steps. The cleaning-liquid in the dip cleaning tank 2 is polluted due to the cleaning of the object 19 and is led into the distilling tank 22 through a tube 18. The cleaning-liquid, polluted in the finish cleaning tank 4, flows through the notched portions 28 and 30 into the rinse cleaning tank 6, through the notched portions 7 and 24 into the dip cleaning tank 2, and through the tube 18 into the distilling tank 22. The polluted liquids led into the distilling tank 22 are heated to at least their vaporization point by the heater 20. The vapor, thus obtained, is used to clean another object 19.

In the third embodiment in accordance with the present invention, as shown in FIG. 4, sluiceways 16 and 26, connected with each other, are disposed below the cooling tubes 15 and 25, respectively. Tubes 17 and 27′, which extend to a finish cleaning tank 4 and a rinse cleaning tank 6, respectively, are connected to the sluiceway 16.

Opposing notched portions 7 and 24 are formed at the upper portions of the side walls 2*a* and 6*a*, respectively, of a dip cleaning tank 2 and the rinse cleaning tank 6, respectively. The cleaning liquid in the rinse cleaning tank 6 flows over the notched portions 7 and 24 into the dip cleaning tank 2. Tubes 8′ and 18 are connected between the finish cleaning tank 4 and the dip cleaning tank 2 and between the dip cleaning tank 2 and the distilling tank 22, respectively. The tubes 8′ and 18 are attached to the rear surface of the frame 9 such that the tubes 8′ and 18 are slanted gradually downwards toward the dip cleaning tank 2 and the distilling tank 22, respectively. The cleaning liquid in the dip cleaning tank 2 flows over into the distilling tank 22 through the tube 18 and the cleaning liquid in the finish cleaning tank 4 flows over into the dip cleaning tank 2 through the tube 8′. The respective liquid levels of the tanks 2, 4, 6 and 22 are arranged so that the respective liquid levels of the finish cleaning tank 4 and the rinse cleaning tank 6 are made to be substantially the same with each other, and the respective liquid levels of the dip cleaning tank 2 and the distilling tank 22 are successively lower.

In the thus arranged apparatus, after being cleaned by vapor in the distilling tank 22, an object 19 is moved successively through the dip cleaning tank 2, the rinse cleaning tank 6, and the finish cleaning tank 4 so as to be subjected to a sequence of cleaning steps. The cleaning liquid, which is polluted in the dip cleaning tank 2 owing to the cleaning of the object 19, is led into the distilling tank 22 through the tube 18 so as to be heated to at least the vaporization point of the cleaning liquid by a heater 20 into vapor that is used to clean another object 19.

As described above, the cleaning liquids polluted in the ultrasonic cleaning tank and the vapor cleaning tank are made to flow over into the distilling tank disposed in the vicinity of the ultrasonic cleaning tank, and the distilled cleaning liquid is supplied to the rinse cleaning tank and the vapor cleaning tank. As a result, the cleaning liquid in each tank is always kept clean and an object to be cleaned can be thoroughly cleaned.

It can be understood that while item number 2 has been described as an ultrasonic cleaning tank in reference to the embodiment of the invention shown in FIG. 2 and as a dip cleaning tank in reference to the embodiments of the invention shown in FIGS. 3 and 4, either device can be used in any of the embodiments of the invention shown and described herein. Similarly, item number 4 is shown and described as a vapor cleaning tank in reference to FIG. 2 and as a finish cleaning tank in reference to FIGS. 3 and 4. Either a vapor cleaning tank or a finish cleaning tank can be used in any of the embodiments of the invention shown or described herein. In the present invention, it can be provided one cooling tube for the distilling tank and other cleaning tank in the same chamber.

Although certain particular embodiments of the invention are herein disclosed for purposes of explanation, various modifications thereof, after study of this specification, will be apparent to those skilled in the art to which the invention pertains, and reference should accordingly be had to the appended claims in determining the scope of the invention. In the present invention, it may be employed a jet stream cleaning tank and a finish tank cleaned up by steam.

What is claimed is:

1. A cleaning apparatus comprising:

an ultrasonic cleaning tank having an ultrasonic vibrator;

a vapor cleaning tank;

a rinse cleaning tank disposed between said ultrasonic cleaning tank and said vapor cleaning tank;

first overflow means to provide an overflow path for a cleaning liquid from said rinse cleaning tank into said ultrasonic cleaning tank;

a distilling tank, having a heater disposed therein to heat cleaning liquid to at least its vaporization point;

second overflow means to direct cleaning liquid from said ultrasonic cleaning tank into said distilling tank;

third overflow means to direct cleaning liquid from said vapor cleaning tank into said distilling tank;

cooling means disposed above said distilling, ultrasonic cleaning, vapor cleaning and rinse cleaning tanks to cool cleaning liquid vapor, vaporized in each of said tanks, to at least its condensation point; and supply means for supplying the condensed cleaning liquid obtained by said cooling means to said rinse cleaning tank and said vapor cleaning tank.

2. A cleaning apparatus as claimed in claim 1, wherein said cooling means comprises first cooling means disposed above said distilling tank to cool vapor, vaporized in said distilling tank, to at least its condensation point and second cooling means disposed above said ultrasonic cleaning tank.

3. A cleaning apparatus as claimed in claim 2 wherein said first cooling means are cooling tubes disposed circumferentially about the inside perimeter of said distilling tank and above the level of cleaning liquid in said distilling tank.

4. A cleaning apparatus as claimed 2 which further includes:

a chamber;

said ultrasonic cleaning tank, said vapor cleaning tank and said rinse cleaning tank being disposed in said chamber; and said second cooling means being cooling tubes disposed circumferentially about the inside perimeter of said chamber and above the level of the cleaning liquid in each of said ultrasonic cleaning tank, said vapor cleaning tank and said rinse cleaning tank.

5. A cleaning apparatus as claimed in claim 1 wherein said second overflow means is a pipe in slanted fixed relation to said ultrasonic cleaning tank and said distilling tank having an outlet in said distilling tank at a first level and an inlet in said ultrasonic tank at a second level, higher than said first level.

6. A cleaning apparatus as claimed in claim 1 wherein said third overflow means is a pipe in slanted fixed relation to said vapor cleaning tank and said distilling tank having an outlet in said distilling tank at a first level and an inlet in said vapor cleaning tank at a third level, higher than the first level.

7. A cleaning apparatus comprising, an ultrasonic cleaning tank having an ultrasonic vibrator, a vapor cleaning tank having a heater disposed therein, a rinse cleaning tank disposed between said ultrasonic cleaning tank and said vapor cleaning tank and arranged so that a cleaning liquid in said rinse cleaning tank is made to flow over from said rinse cleaning tank into said ultrasonic cleaning tank, said cleaning apparatus further comprising:

a distilling tank having a heater at its inside lower portion and being disposed in the vicinity of said ultrasonic cleaning tank, said vapor cleaning tank, and said rinse cleaning tank;

a flow over means for making cleaning liquids in said ultrasonic cleaning tank and said vapor cleaning tank flow over into said distilling tank;

a cooling means for cooling and liquefying vapor obtained by heating and vaporizing the cleaning liquid in each of said tanks into a purified cleaning liquid; and a supply means for supplying the purified cleaning liquid obtained by said cooling means into said rinse cleaning tank and said vapor cleaning tank.

8. A cleaning apparatus comprising:

a dipping cleaning tank for dipping-cleaning an object to be cleaned;

a finish cleaning tank for finish cleaning said object to be cleaned;

a rinse cleaning tank;

a regenerative tank for regenerating a cleaning liquid by distilling a polluted cleaning liquid;

cooling means disposed above said tanks for cooling and liquefying vapor of a cleaning liquid vaporized in each of said tanks;

flow over means for allowing a cleaning liquid in said dipping cleaning tank, said finish cleaning tank and said rinse cleaning tank to flow over into said regenerative tank; and supply means for supplying a cleaning liquid obtained by said cooling means into at least said finish cleaning tank.

9. The cleaning apparatus as claimed in claim 8, wherein said dipping cleaning tank providing an ultrasonic vibrator in a lower portion of said dipping cleaning tank.

10. The cleaning apparatus as claimed in claim 8, wherein said finish cleaning tank is for vapor cleaning.

11. A cleaning apparatus comprising a dipping cleaning tank for dipping-cleaning an object to be cleaned, a finish cleaning tank having a heater disposed therein, and a rinse cleaning tank disposed between said dipping cleaning tank and said finish cleaning tank and arranged so that a cleaning liquid in said rinse cleaning tank is made to flow over from said rinse cleaning tank, said cleaning apparatus further comprising:

a distilling tank having a heater at its inside lower portion and being disposed adjacent said dipping cleaning tank, said finish cleaning tank, and said rinse cleaning tank;

flow over means for allowing a cleaning liquid in said finish cleaning tank, said dipping cleaning tank and said rinse cleaning tank to flow over into said distilling tank;

cooling means for cooling vapor obtained through vaporization of a cleaning liquid in each of said tanks and disposed above said tanks to liquify said vapor into a purified cleaning liquid; and supply means for supplying purified cleaning liquid obtained by said cooling means into said finish cleaning tank.

* * * * *